US012385271B2

(12) United States Patent
Fränkel et al.

(10) Patent No.: US 12,385,271 B2
(45) Date of Patent: Aug. 12, 2025

(54) UNDERWATER CLEANER

(71) Applicants: Andrés Fränkel, Perchtoldsdorf (AT); Benjamin Fränkel, Perchtoldsdorf (AT); Constantin Fränkel, Perchtoldsdorf (AT)

(72) Inventors: Andrés Fränkel, Perchtoldsdorf (AT); Benjamin Fränkel, Perchtoldsdorf (AT); Constantin Fränkel, Perchtoldsdorf (AT)

( * ) Notice: Subject to any disclaimer, the term of this patent is extended or adjusted under 35 U.S.C. 154(b) by 296 days.

(21) Appl. No.: 17/988,380

(22) Filed: Nov. 16, 2022

(65) Prior Publication Data

US 2023/0258015 A1 Aug. 17, 2023

(30) Foreign Application Priority Data

Nov. 17, 2021 (AT) ..... A 50921/2021

(51) Int. Cl.
*E04H 4/16* (2006.01)
*A47L 9/04* (2006.01)

(52) U.S. Cl.
CPC ..... *E04H 4/1636* (2013.01); *E04H 4/16* (2013.01); *A47L 9/04* (2013.01); *E04H 4/1654* (2013.01)

(58) Field of Classification Search
CPC . E04H 4/16; E04H 4/1636; A47L 9/04; A47L 5/30
See application file for complete search history.

(56) References Cited

U.S. PATENT DOCUMENTS

| | | | | |
|---|---|---|---|---|
| 4,950,393 | A | 8/1990 | Goettl | |
| 5,371,910 | A * | 12/1994 | Sebor | E04H 4/1654 137/527 |
| 5,706,540 | A * | 1/1998 | Niewiarowski | E04H 4/1663 137/561 R |
| D453,246 | S | 1/2002 | Nimmo | |
| 6,502,269 | B1 | 1/2003 | Balchan et al. | |
| 11,091,925 | B2 * | 8/2021 | Erlich | E04H 4/1636 |
| 11,149,458 | B1 * | 10/2021 | Mjelde | E04H 4/1636 |
| 2007/0107148 | A1 | 5/2007 | Rowan et al. | |

FOREIGN PATENT DOCUMENTS

| | | | |
|---|---|---|---|
| FR | 2667099 | A1 | 11/1993 |
| WO | 2005/02189 | A1 | 3/2005 |

* cited by examiner

*Primary Examiner* — Michael D Jennings
(74) *Attorney, Agent, or Firm* — Dykema Gossett PLLC

(57) ABSTRACT

The invention relates to an underwater cleaner, in particular for a swimming pool, comprising a suction nozzle housing having a suction nozzle which communicates with a suction chamber, and having a suction mouth which defines a suction plane, wherein an outlet channel stems from the suction chamber, which outlet channel has a connection for a filter device in the region of its outlet opening, and comprising at least one water jet nozzle which opens into the suction chamber in the region of the suction nozzle and via which water can be fed under pressure into the suction chamber such that a negative pressure is established in the suction chamber according to the water jet pump principle, wherein a first water jet nozzle opens into the suction chamber in such a way that a flow center line of the first water jet nozzle is directed into the outlet channel.

24 Claims, 3 Drawing Sheets

UNDERWATER CLEANER

CROSS-REFERENCE TO RELATED APPLICATION

This application is claims the benefit of priority to Austria application No. A 50921/2021, filed 17 Nov. 2021.

BRIEF SUMMARY

The invention relates to an underwater cleaner, in particular for a swimming pool, comprising a suction nozzle housing having a suction nozzle which communicates with a suction chamber, and having a suction mouth which defines a suction plane, wherein an outlet channel stems from the suction chamber, which outlet channel has a connection for a filter device in the region of its outlet opening, and comprising at least one water jet nozzle which opens into the suction chamber in the region of the suction nozzle and via which water can be fed under pressure into the suction chamber such that a negative pressure is established in the suction chamber according to the water jet pump principle, wherein a first water jet nozzle opens into the suction chamber in such a way that a flow center line of the first water jet nozzle is directed into the outlet channel, wherein the first water jet nozzle is formed in one piece with the suction nozzle housing and the suction nozzle housing can be produced together with the first water jet nozzle by injection molding.

BACKGROUND

WO 2005/021896 A1 discloses an underwater cleaner comprising a suction nozzle housing which forms a suction chamber. Stemming from the suction chamber, which communicates with a suction nozzle, is an outlet channel, to the connection opening of which a filter bag can be connected. Opening into the suction chamber is a water jet nozzle, which is directed into the outlet channel.

U.S. Pat. No. 6,502,269 B1 discloses a battery-operated swimming pool vacuum cleaner, in which, according to the water jet pump principle, water together with contaminants is aspirated through a suction nozzle and is conveyed into a filter. Since the water jet nozzle opens into the suction chamber at a relatively large distance from the suction nozzle, higher-mass dirt particles cannot be removed or can be removed only with difficulty. The water jet nozzle is supplied by a submersible pump, which draws water at the highest point of the suction chamber through a screen. This has the disadvantage that, when starting the swimming pool vacuum cleaner, the submersible pump conveys only air for a relatively long period of time, unless the suction chamber is manually flooded beforehand. In any case, start-up is difficult. The minimum operating depth is determined by the relatively large distance between the intake opening of the submersible pump and the surface to be cleaned. Because water is aspirated from the suction chamber, there is a risk that particles will very quickly clog the screen.

Furthermore, to U.S. Design 453,246 S discloses a suction nozzle for a swimming pool vacuum cleaner, in which dirty water is aspirated according to the water jet pump or Venturi pump principle. For this purpose, a water hose from an external water pressure source can be connected to the suction nozzle. Owing to the water flowing into the suction chamber through the water jet nozzle, a negative pressure is established in the suction chamber, as a result of which dirty water is aspirated through the suction nozzle. The disadvantage is that with this suction nozzle, too, only relatively light and low-mass dirt particles can be removed.

In addition, U.S. Pat. No. 4,950,393 A discloses a swimming pool cleaner which has a collecting line for water fed in under pressure, from which a number of sweeping hoses branch off, via which dirt is whirled up. From the collecting line, jet nozzles also lead into the suction chamber of the swimming pool cleaner, which suction chamber is designed as a Venturi chamber, the jet nozzles being distributed around the circumference of the suction nozzle. According to the water jet principle, water is aspirated from the region of the floor of the swimming pool and is conveyed to a filter. Since the jet nozzles lead away from the suction plane substantially at an angle of around 90°, they cannot be used to tear away dirt on the swimming pool floor. This function has to be performed by the sweeping hoses. This swimming pool cleaner is complicated, bulky, and relatively unwieldy to use. In addition, a high water throughput and thus a pump with a high output is required.

US 2007/107148 A1 discloses a portable underwater cleaner having a water jet nozzle, the flow center line of which is directed into the outlet channel. The water jet nozzle is formed in one piece with the suction nozzle housing of the underwater cleaner, but cannot be formed by a slider that can be pulled through the outlet channel from the side of the connection for the filter device.

FR 2 667 099 A1 discloses a swimming pool vacuum cleaner, wherein two water jet nozzles open tangentially into a suction chamber and generate a swirl flow. The water jet nozzles are directed onto the suction plane, the flow center line of the water jet nozzles enclosing with the suction plane an angle ≤0°. Solid deposits on the swimming pool floor can thus be removed, but the output through the water jet principle is relatively low on account of the unfavorable flow arrangement. The dirt is whirled up by the water jet nozzles, and therefore re-soiling of the swimming pool by stray dirt particles cannot be ruled out. Another disadvantage is that two water jet nozzles are required, meaning that a pump with a relatively high output has to be provided.

The water jet nozzle and/or the water inlet channel are predominantly formed by separate parts, which has a disadvantageous effect on the production cost.

SUMMARY OF THE INVENTION

The object of the invention is to provide an underwater cleaner that has a high degree of efficiency and a low production cost.

According to the invention, this is achieved in that the first water jet nozzle can be formed by a slider that can be pulled through the outlet channel from the side of the connection for the filter device, and in that the first water jet nozzle widens in the direction of flow of the water jet.

The suction effect can be significantly increased if at least a second water jet nozzle, arranged at a distance from the first water jet nozzle, opens into the suction chamber or into the outlet channel, wherein preferably the second water jet nozzle is arranged on a side of the first water jet nozzle remote from the suction nozzle.

The best cleaning results can be achieved if a first distance between a mouth of the first water jet nozzle and a mouth of the second water jet nozzle is smaller than a maximum diameter of the first water jet nozzle or second water jet nozzle, preferably smaller than half the maximum diameter of the first water jet nozzle or second water jet nozzle. It is highly advantageous if the mouth of the second water jet nozzle is arranged at a distance from a wall of the outlet channel, wherein preferably a second distance between the mouth of the second water jet nozzle and the wall of the outlet channel is at least 1 mm, particularly preferably at least 2 mm.

According to one embodiment variant of the invention, a flow center line of the second water jet nozzle and a central flow axis of the outlet channel are substantially parallel to each other.

The second water jet nozzle may have a circular mouth and may be formed by a drilled bore. Advantageously, the second water jet nozzle has a circular cross-section with a diameter of at least 2 mm and at most 6 mm or an equivalent cross-section corresponding to this circular cross-section. In this way, the suction effect of the first water jet nozzle is aided by the second water jet nozzle.

Like the first water jet nozzle, the second water jet nozzle may also be formed in one piece with the suction nozzle housing and can be produced together with the suction nozzle housing by injection molding, wherein the second water jet nozzle can be formed by a slider that can be pulled through the outlet channel from the side of the connection for the filter device. Easy and inexpensive production is thus possible.

It is preferably provided that at least one water jet nozzle stems from a water inlet channel which is preferably formed in one piece with the suction nozzle housing.

Easy production by means of a slider pushed in from the connection opening side can be made possible if the first water jet nozzle forms a cone angle between 10° and 45°, preferably 20° to 35°.

A high degree of efficiency can be achieved if the water jet of at least one water jet nozzle and/or a flow center line of at least one water jet nozzle is directed onto a lower first side of the outlet channel, located closer to the suction plane, or onto the outlet opening.

A high suction effect can be achieved if the distance between the water jet nozzle and the suction plane is smaller than the smallest internal width of the outlet channel, and if a flow center line of the first water jet nozzle, in the region of the mouth in the suction chamber, encloses with the suction plane a first angle ≥0°, preferably >0° and ≤45°, wherein preferably the distance between the first water jet nozzle and the suction plane is at most two-thirds of the smallest internal width, preferably at most half the smallest internal width of the outlet channel. Whirling-up of the dirt is to be avoided as far as possible. In order to achieve this and yet nevertheless obtain a good suction and cleaning effect, it is advantageous if the first angle between the flow center line of the first water jet nozzle and the suction plane is preferably ≤25°, particularly preferably ≤15°.

In particular, it is advantageous if the distance between the first water jet nozzle and the suction plane is smaller than half the maximum height of the suction chamber. In practice, it has proven to be advantageous if the distance between the first water jet nozzle and the suction plane is at most 3 cm, preferably at most 0.9 cm to 2 cm. As a result, even small and medium-sized pebbles can be removed, for example.

It is advantageous for a good cleaning effect if the water jet opens into the suction chamber as close to the suction plane as possible. The effect of this is that the water jet flows directly onto the dirt particles and tears these away in the direction of the outlet channel, so that even relatively high-mass dirt particles, which could not be removed simply by the suction effect alone, can be detached from the floor of the swimming pool and conveyed into the filter. The soiling is therefore removed by a combined suction and pressure effect as a result of the water jet. It is particularly advantageous if at least one water jet nozzle opens into the suction chamber on a side opposite the outlet channel, wherein it is preferably provided that at least one water jet nozzle is directed into the outlet channel, wherein particularly preferably the flow center line of the first water jet nozzle encloses with the central flow axis of the outlet channel a second angle greater than 0°, preferably between 20° and 45°. A particularly good suction power can be achieved if the central flow axis of the outlet channel is inclined relative to the suction plane by a fourth angle between 0° and 45°, preferably between 20° and 30°. The distance between the first water jet nozzle and the suction plane and the internal width of the suction nozzle are preferably somewhat smaller than the width of the outlet channel. As a result, high flow velocities can be achieved in the region of the suction nozzle, which aids the cleaning effect.

In one embodiment variant of the invention, it is provided that at least one water jet nozzle is arranged transversely to the water inlet channel, wherein preferably the flow center line of the first water jet nozzle encloses with a flow center axis of the water inlet channel, at least in the region of the first water jet nozzle, a third angle between 90° and 140°, particularly preferably between 100° and 120°.

Furthermore, in order to achieve a high suction effect, it may be provided that the flow center line of the second water jet nozzle encloses with the flow center axis of the water inlet channel, at least in the region of the second water jet nozzle, a second third angle between 45° and 120°, preferably between 60° and 90°.

In one particularly simple embodiment of the invention, it is provided that a water hose, which is connected to a preferably external pressure source, can be connected to at least one water jet nozzle or to a water inlet channel leading to at least one water jet nozzle.

In a further embodiment of the invention, it is provided that the outlet channel and the filter device are arranged on the actuation side of the suction nozzle housing facing toward the user. By arranging the filter device and the outlet channel on the actuation side, this avoids protrusions on the side opposite the actuation side, which hinder the view of dirt; as a result, by using the actuating rod, the user can guide the underwater cleaner very precisely over the dirt to be removed.

BRIEF DESCRIPTION OF THE DRAWINGS

The invention will be explained in greater detail below on the basis of an exemplary embodiment which is shown in the non-limiting figures. In the figures.

DETAILED DESCRIPTION

Figure 5:
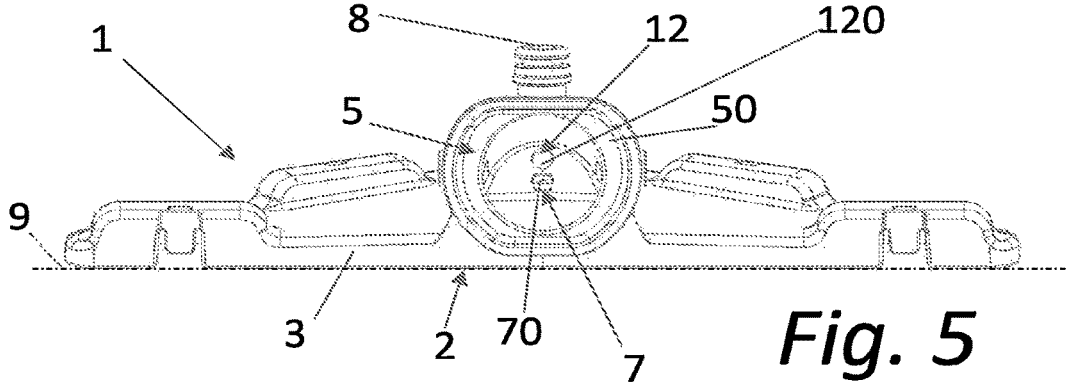
FIG. 5 shows the underwater cleaner according to the invention in a second embodiment variant in a view from the outlet opening side.
Figure 6:
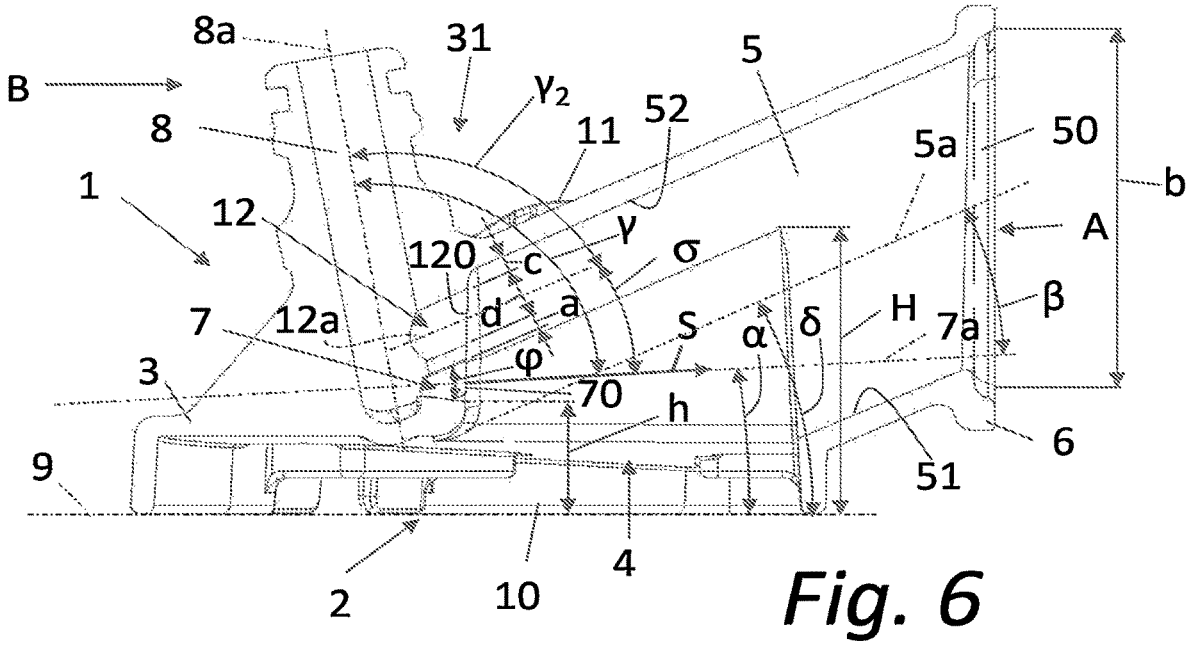
FIG. 6 shows this underwater cleaner in longitudinal section.
Figure 7:
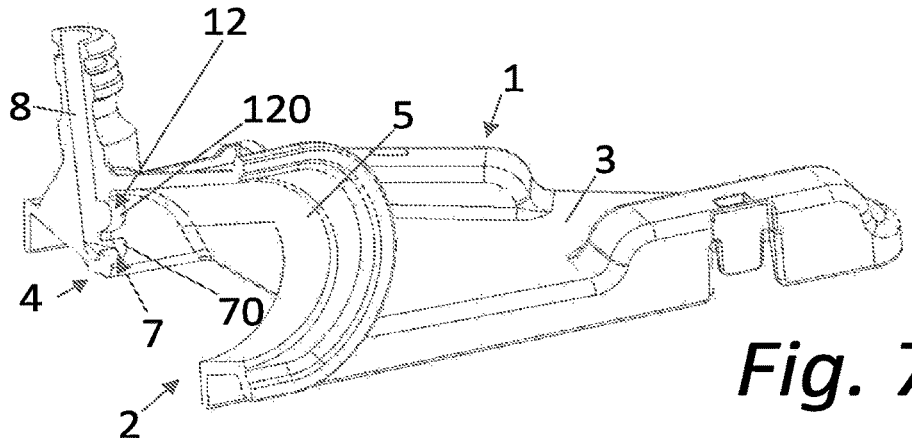
FIG. 7 shows this underwater cleaner in longitudinal section in an axonometric view.

FIG. 1 to FIG. 4 show an underwater cleaner 1 in a first embodiment variant with a first water jet nozzle 7. FIG. 5 to FIG. 7 show an underwater cleaner 1 in a second embodiment variant with a first water jet nozzle 7 and a second water jet nozzle 12.

In each embodiment variant, the underwater cleaner 1 comprises a suction nozzle housing 3, which forms a suction nozzle 2 and includes a suction chamber 4 starting from a suction mouth 10. Stemming from the suction chamber 4 is an outlet channel 5 which has a connection 6 for a filter device, for example a filter bag, in the region of an outlet opening 50.

The underwater cleaner 1 operates according to the water jet pump principle. A first water jet nozzle 7 opens into the dome-like suction chamber 4 in the region of the suction nozzle 2, said first water jet nozzle being fluidically connected to an external pressure source, for example a water hose or a submersible pump, via a water inlet channel 8.

A sharp water jet is supplied to the suction chamber 4 via the water inlet channel 8 and the first water jet nozzle 7 and generates a negative pressure in the suction chamber 4, as a result of which contaminated water is aspirated through the suction nozzle 2 and ultimately is conveyed via the outlet channel 5 into the filter device (not shown in further detail). The water passes through the filter device and is then fed back into the swimming pool.

The first water jet nozzle 7 is arranged as close to the suction plane 9 as possible. The distance h between the first water jet nozzle 7 and the suction plane 9 is at most ⅔ of the smallest internal width b and is preferably at most half the smallest internal width b of the outlet channel 5.

It has proven to be advantageous for the effect of the underwater cleaner 1 if the distance h between the mouth 70 of the first water jet nozzle 7—namely the lower edge 71 of the mouth 70 of the first water jet nozzle 7 located closest to the suction plane 9—and the suction plane 9 is smaller than or equal to 50% of the internal width b of the outlet channel 5. In particular, it is advantageous if the distance h between the first water jet nozzle 7 and the suction plane 9 is smaller than or equal to half the maximum height H of the suction chamber 4. In advantageous practical exemplary embodiments, the distance h is for example less than 3 cm, preferably less than 2 cm.

As a result, even relatively high-mass contaminants, such as small and medium pebbles for example, can be removed from the body to be cleaned, for example from the floor of a swimming pool, since the pebbles are torn away by the water jet and are pushed in the direction of the outlet channel 5. The effect of the underwater cleaner 1 is thus based on a combined suction and pressure effect as a result of the water jet flowing into the suction chamber 4, this being indicated by the arrow S in FIG. 3 and FIG. 6. The best suction effect is achieved when, during operation, the suction plane 9 coincides with the plane of the body to be cleaned.

Figure 3:
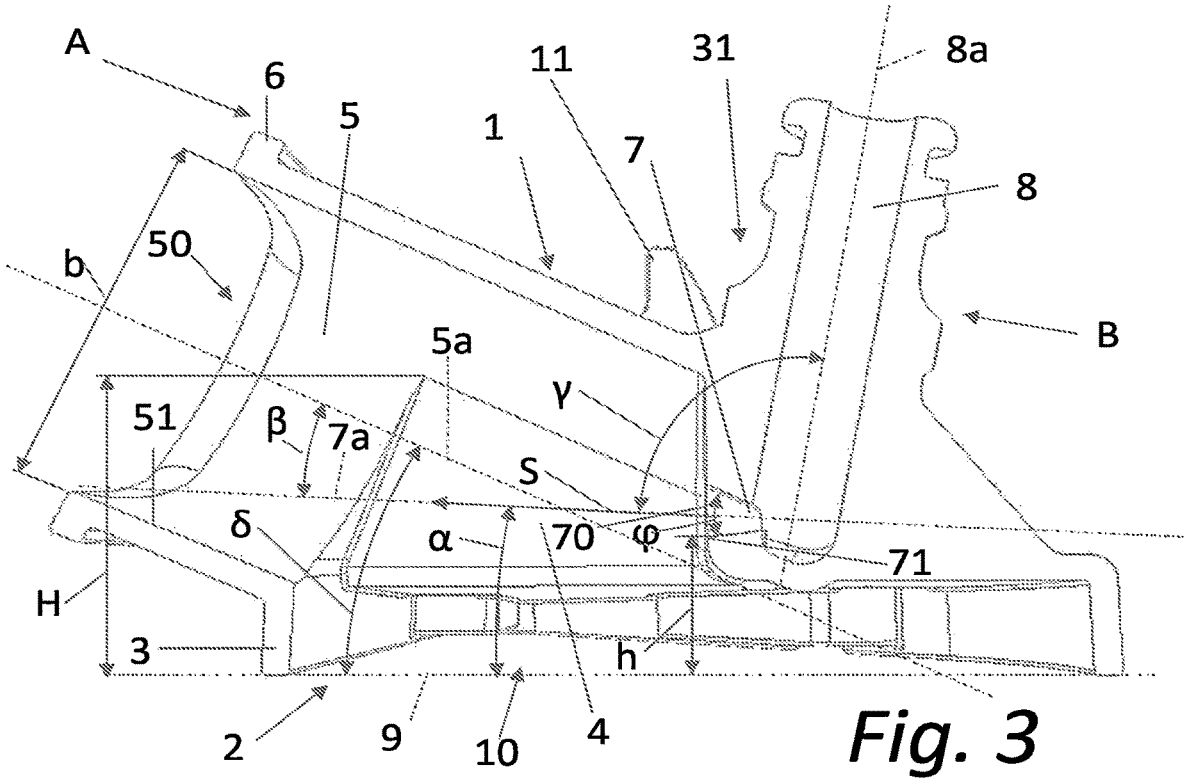
FIG. 3 shows this underwater cleaner in longitudinal section.
Figure 4:
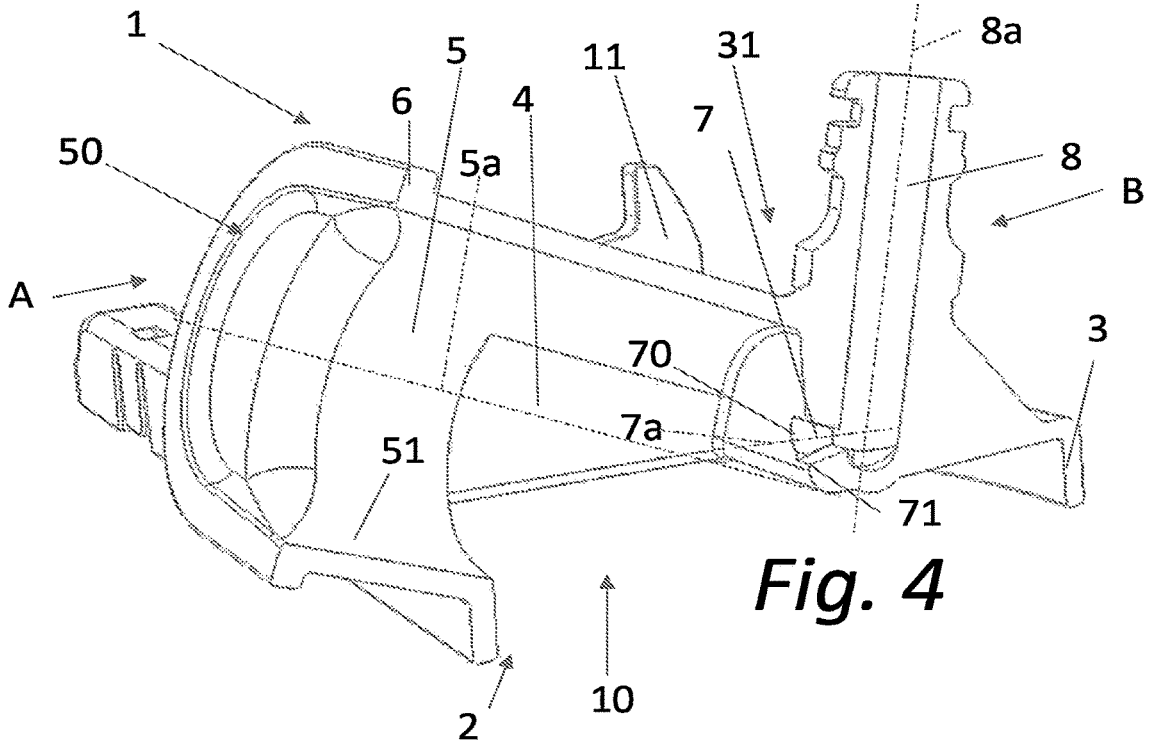
FIG. 4 shows this underwater cleaner in longitudinal section in an axonometric view.

In the exemplary embodiment, the first water jet nozzle 7, in the region of the mouth 70 in the suction chamber 4, is slightly inclined upward in the direction of the outlet channel 5, as can be seen from FIG. 3 and FIG. 6, in order to make it possible for the contaminants to be quickly transported away into the filter device. If the first angle α, which is enclosed at one side by the center line 7*a* in the region of the mouth 70 of the first water jet nozzle 7 in the suction chamber 4 and at the other side by the suction plane 9 in the bottom region of the suction nozzle housing 3, which suction plane is approximately parallel to the body to be cleaned during operation of the underwater cleaner 1, is at most 45°, preferably at most 25°, particularly preferably at most 15°, so that the water jet indicated by the arrow S in FIG. 3 and FIG. 6 flows in the direction of the outlet channel 5, it is possible for the contaminants to be quickly transported away into the filter device.

Figure 1:
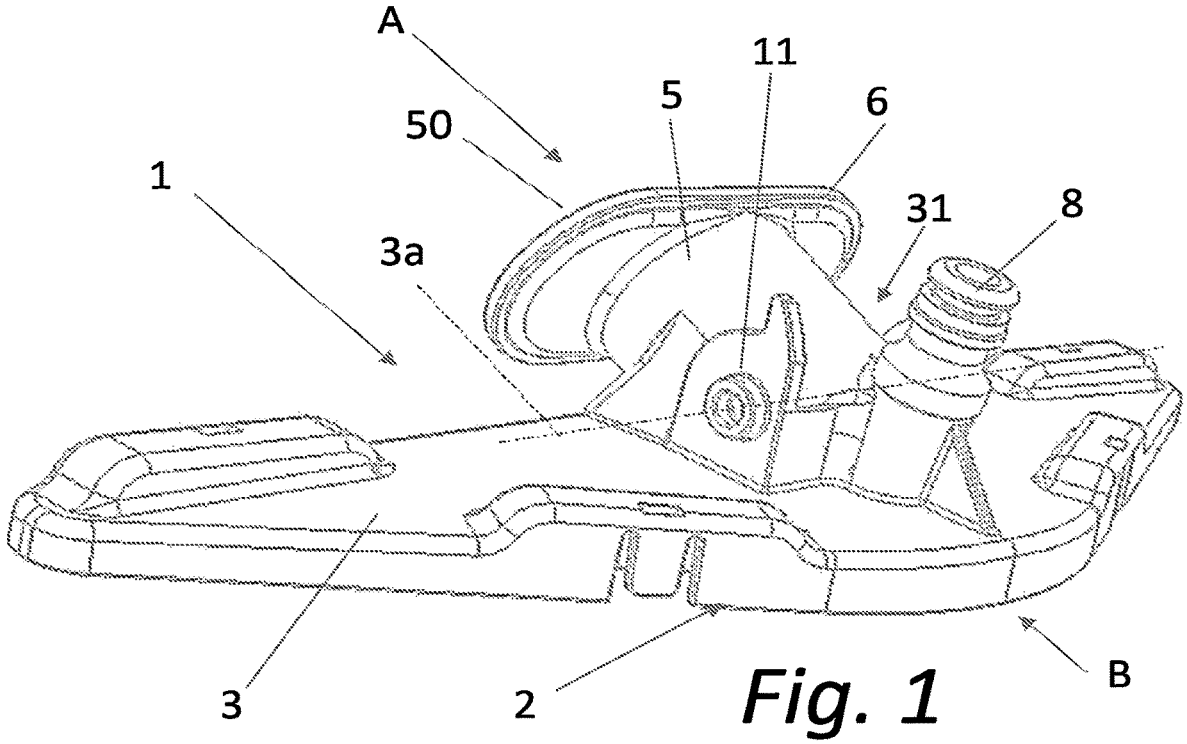
FIG. 1 shows the underwater cleaner according to the invention in a first embodiment variant in an axonometric view.
Figure 2:
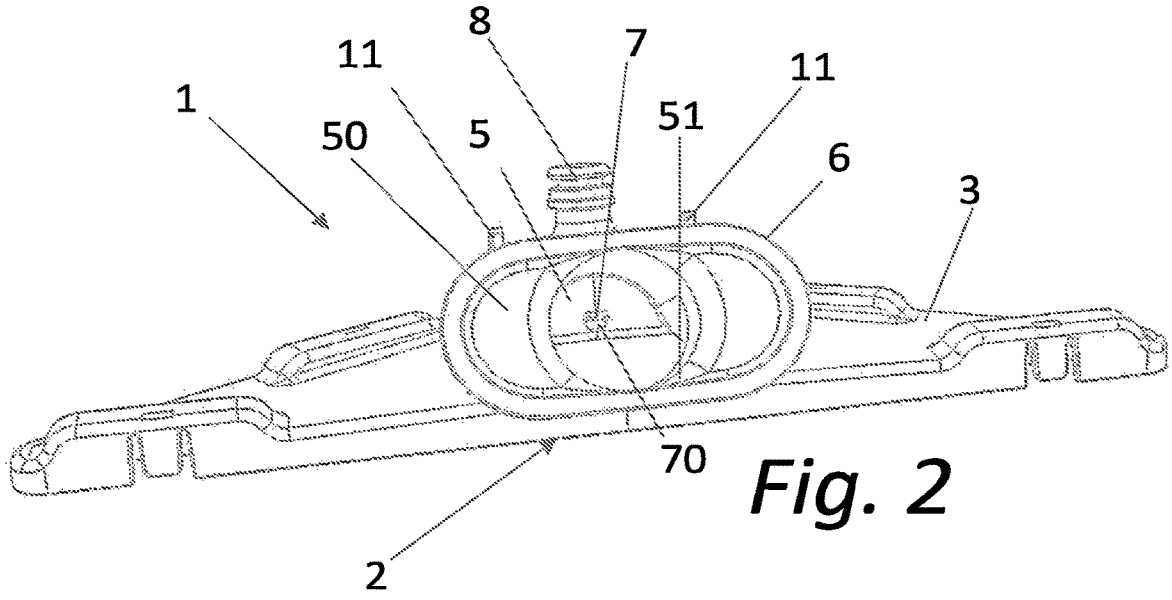
FIG. 2 shows this underwater cleaner in another axonometric view.

Arranged on the suction nozzle housing 3, on an upper side 31 remote from the suction plane 9, in a region located between the outlet channel 5 and the water inlet channel 8, is at least one receptacle 11 for a fork-shaped holder (not shown in further detail) for an actuating rod that can be pivoted relative to the suction nozzle housing 3 about a pivot axis 3*a*. The outlet channel 5 and the filter device are arranged on the actuation side A of the suction nozzle housing 3 facing toward the user. The side of the suction nozzle housing 3 facing away from the user is denoted by B (FIG. 1, FIG. 3, FIG. 6).

The first water jet nozzle 7 is formed in one piece with the suction nozzle housing 3 and can be produced together with the suction nozzle housing 3 by injection molding. The first water jet nozzle 7 can be formed by a slider (not shown in further detail) that can be pulled through the outlet channel 5 from the side of the connection 6 for the filter device, i.e., from the actuation side A.

The first water jet nozzle 7 widens in the direction of flow of the water jet and preferably forms a cone angle φ between 10° and 45°, preferably 20° to 35°.

The first water jet nozzle 7 stems from the water inlet channel 8 formed in one piece with the suction nozzle housing 3, the first water jet nozzle 7 being arranged transversely to the water inlet channel 8.

The flow center line 7*a* of the first water jet nozzle 7 encloses with the central flow axis 5*a* of the outlet channel 5 a second angle β greater than 0° , preferably between 20° and 45°.

The flow center line 7*a*—at least in the region of the first water jet nozzle 7—encloses with the flow center axis 8*a* of the water inlet channel 8 a third angle γ between 90° and 140°, in particular between 100° and 120°.

The central flow axis 5*a* of the outlet channel 5 is inclined relative to the suction plane 9 by a fourth angle δ between 0° and 45°, preferably between 20° and 30°.

The first water jet nozzle 7 opens into the suction chamber 4 on the side B located opposite the outlet channel 5 and facing away from the user. The water jet of the first water jet nozzle 7 and/or the flow center line 7*a* of the first water jet nozzle 7 is directed onto a lower first side 51 of the outlet channel 5, located closer to the suction plane 9, or onto the outlet opening 50.

The second embodiment variant shown in FIG. 5 to FIG. 7 differs from the first embodiment variant shown in FIGS. 1 to 4 in that a second water jet nozzle 12 is provided in addition to the first water jet nozzle 7. The second water jet nozzle 12 opens into the outlet channel 5 or into the suction chamber 4 in the region of a side of the first water jet nozzle 7 remote from the suction plane 9.

The second water jet nozzle 12 is arranged on a side of the first water jet nozzle 7 remote from the suction nozzle 2. A first distance a between the mouth 70 of the first water jet nozzle 7 and the mouth 120 of the second water jet nozzle 12 is smaller than half the maximum diameter d of the first water jet nozzle 7 or the second water jet nozzle 12.

The mouth 120 of the second water jet nozzle 12 is arranged at a distance from the wall 52 of the outlet channel 5. A second distance c between a downwardly directed region of the wall 52, i.e., a region of the wall facing toward the suction plane 9 and arranged at a maximum distance therefrom, and the mouth 120 of the second water jet nozzle 12 is at least 1 mm, for example at least 2 mm.

The flow center line 12*a* of the second water jet nozzle 12 encloses with the flow center axis 8*a* of the water inlet channel 8, at least in the region of the second water jet nozzle 12, a second third angle $\gamma_2$ between 45° and 120°, for example between 60° and 90°.

The flow center line 7*a* of the first water jet nozzle 7 and the flow center line 12*a* of the second water jet nozzle 12 enclose with each other a fifth angle $\sigma>0°$, for example between 20° and 45°.

The second water jet nozzle 12 has, for example, a substantially circular mouth 120 and may be circular-cylindrical, for example formed by a drilled bore.

The second water jet nozzle 12 may have a circular cross-section with a diameter d of at least 2 mm and at most 6 mm or an equivalent cross-section corresponding to this circular cross-section. The cross-sectional area of the mouth 70 of the first water jet nozzle 7 may substantially correspond to the cross-sectional area of the mouth 120 of the second water jet nozzle 12.

Like the first water jet nozzle 7, the second water jet nozzle 7 may thus also be formed in one piece with the suction nozzle housing 3.

By way of example, the second water jet nozzle 12 may be formed by a drilled bore. As an alternative to being produced by drilling, the second water jet nozzle 12 can also be produced together with the suction nozzle housing 3 and the first water jet nozzle 7 by injection molding, wherein the second water jet nozzle 12 is likewise formed by a slider that can be pulled through the outlet channel 5 from the side A of the connection 6 for the filter device. In both cases, it is advantageous for production if the second water jet nozzle 12 extends parallel to the outlet channel 5 and the flow center line 12*a* is arranged parallel to the central flow axis 5*a* of the outlet channel 5.

The invention claimed is:

1. An underwater cleaner, in particular for a swimming pool, comprising:

a suction nozzle housing having a suction nozzle which communicates with a suction chamber, and having a suction mouth which defines a suction plane, wherein an outlet channel stems from the suction chamber, which outlet channel has a connection for a filter device in the region of its outlet opening, and including at least one water jet nozzle which opens into the suction chamber in the region of the suction nozzle and via which water is fed under pressure into the suction chamber such that a negative pressure is established in the suction chamber according to the water jet pump principle, wherein a first water jet nozzle opens into the suction chamber in such a way that a flow center line of the first water jet nozzle is directed into the outlet channel, and wherein the first water jet nozzle is formed in one piece with the suction nozzle housing and the suction nozzle housing is produced together with the first water jet nozzle by injection molding, and the first water jet nozzle widens in the direction of flow of the water jet of the first water jet nozzle.

2. The underwater cleaner according to claim 1, wherein at least a second water jet nozzle, arranged at a distance from the first water jet nozzle, opens into the suction chamber or into the outlet channel.

3. The underwater cleaner according to claim 2, wherein the second water jet nozzle is arranged on a side of the first water jet nozzle remote from the suction nozzle.

4. The underwater cleaner according to claim 2, wherein a first distance between a mouth of the first water jet nozzle and a mouth of the second water jet nozzle is smaller than a maximum diameter of the first water jet nozzle or second water jet nozzle.

5. The underwater cleaner according to claim 2, wherein the mouth of the second water jet nozzle is arranged at a distance from a wall of the outlet channel, wherein a second distance between the mouth of the second water jet nozzle and the wall of the outlet channel is at least 1 mm.

6. The underwater cleaner according to claim 2, wherein a flow center line of the second water jet nozzle and a central flow axis of the outlet channel are substantially parallel to each other.

7. Underwater cleaner according to claim 2, wherein the second water jet nozzle has a circular mouth, the second water jet nozzle being formed by a drilled bore.

8. Underwater cleaner according to claim 2, wherein the second water jet nozzle has a circular cross-section with a diameter of at least 2 mm or an equivalent cross-section corresponding to this circular cross-section.

9. Underwater cleaner according to claim 2, wherein the second water jet nozzle has a circular cross-section with a diameter of at most 6 mm or an equivalent cross-section corresponding to this circular cross-section.

10. Underwater cleaner according to claim 2, wherein the second water jet nozzle is formed in one piece with the suction nozzle housing.

11. Underwater cleaner according to claim 10, wherein the second water jet nozzle is produced together with the suction nozzle housing by injection molding, wherein the second water jet nozzle is formed by the slider that is pulled through the outlet channel from the actuation side of the connection for the filter device.

12. Underwater cleaner according to claim 2, wherein the flow center line of the first water jet nozzle encloses with the flow center line of the second water jet nozzle a fifth angle greater than 0.

13. Underwater cleaner according to claim 1, wherein at least one water jet nozzle stems from a water inlet channel which is formed in one piece with the suction nozzle housing.

14. Underwater cleaner according to claim 1, wherein the first water jet nozzle forms a cone angle between 10° and 45°.

15. Underwater cleaner according to claim 1, wherein the water jet of at least one water jet nozzle and/or the flow center line of at least one water jet nozzle is directed onto a lower first side of the outlet channel, located closer to the suction plane, or onto the outlet opening.

16. Underwater cleaner according to claim 1, wherein the flow center line of the first water jet nozzle, in the region of the mouth in the suction chamber, encloses with the suction plane a first angle $\geq 0°$.

17. Underwater cleaner according to claim 16, wherein the first angle between the flow center line of the water jet nozzle and the suction plane is $\leq 25°$.

18. Underwater cleaner according to claim 1, wherein the flow center line of the first water jet nozzle encloses with the central flow axis of the outlet channel a second angle greater than 0°.

19. Underwater cleaner according to claim 1, wherein at least one water jet nozzle is arranged transversely to the water inlet channel, wherein the flow center line of the first water jet nozzle encloses with a flow center axis of the water inlet channel, at least in the region of the first water jet nozzle, a third angle between 90° and 140°.

20. Underwater cleaner according to claim 19, wherein the flow center line of the second water jet nozzle encloses with the flow center axis of the water inlet channel, at least in the region of the second water jet nozzle, a second third angle between 45° and 120°.

21. Underwater cleaner according to claim 1, wherein the distance between the first water jet nozzle and the suction plane is smaller than the smallest internal width of the outlet channel, wherein the distance between the first water jet nozzle and the suction plane is at most ⅔ of the smallest internal width.

22. Underwater cleaner according to claim 1, wherein the outlet channel and the connection for the filter device are arranged on the actuation side of the suction nozzle housing facing toward the user.

23. Underwater cleaner according to claim 1, wherein the central flow axis of the outlet channel is inclined relative to the suction plane by a fourth angle between 0° and 45°.

24. Underwater cleaner according to claim 1, wherein at least one water jet nozzle opens into the suction chamber on a side opposite the outlet channel.

* * * * *